US011898474B2

(12) United States Patent
Ulishney

(10) Patent No.: US 11,898,474 B2
(45) Date of Patent: Feb. 13, 2024

(54) CONSTANT VELOCITY MUFFLER ASSEMBLY

(71) Applicant: John Ulishney, Greensburg, PA (US)

(72) Inventor: John Ulishney, Greensburg, PA (US)

( * ) Notice: Subject to any disclaimer, the term of this patent is extended or adjusted under 35 U.S.C. 154(b) by 8 days.

(21) Appl. No.: 17/730,306

(22) Filed: Apr. 27, 2022

(65) Prior Publication Data

US 2023/0349309 A1 Nov. 2, 2023

(51) Int. Cl.
*F01N 1/12* (2006.01)
*F01N 1/02* (2006.01)
*F01N 1/08* (2006.01)

(52) U.S. Cl.
CPC ..... *F01N 1/02* (2013.01); *F01N 1/08* (2013.01); *F01N 1/12* (2013.01); *F01N 2240/20* (2013.01)

(58) Field of Classification Search
CPC ... F01N 1/088; F01N 1/08; F01N 1/12; F01N 2240/20
USPC ..... 181/247, 248, 258, 264
See application file for complete search history.

(56) References Cited

U.S. PATENT DOCUMENTS 1,575,657 A * 3/1926 Straussler ..... F01N 1/10 181/258
1,816,245 A * 7/1931 Wolford ..... F01N 1/088 181/274
2,122,086 A * 6/1938 Chase ..... F01N 1/089 181/269
2,990,906 A * 7/1961 Audette ..... F01N 1/10 181/256
3,114,431 A * 12/1963 Sanders ..... F01N 1/04 181/256
3,704,763 A * 12/1972 Becker ..... F01N 1/084 181/268
4,226,298 A * 10/1980 Bancel ..... F01N 1/10 60/314
4,252,212 A * 2/1981 Meier ..... F01N 1/10 181/252
4,263,982 A * 4/1981 Feuling ..... F01N 1/085 181/256
4,993,512 A * 2/1991 Lescher ..... F01N 1/082 181/227
5,936,210 A * 8/1999 Borneby ..... F01N 1/10 181/256
5,962,822 A * 10/1999 May ..... F01N 1/086 181/258
6,332,511 B1 * 12/2001 Parlato ..... G10K 11/161 181/282
6,520,286 B1 2/2003 Frederiksen
6,571,910 B2 * 6/2003 Storm ..... F01N 1/04 181/268
6,868,939 B2 3/2005 Ziehl
7,426,980 B2 9/2008 Bassani
(Continued)

*Primary Examiner* — Jeremy A Luks

(57) ABSTRACT

A constant velocity muffler assembly for maximizing the exhaust performance of an internal combustion engine includes a muffler that is fluidly coupled to an exhaust pipe of an internal combustion engine to facilitate exhaust gasses to pass through the muffler. A cylinder is disposed within the muffler and the muffler swells outwardly at a middle of the muffler to accommodate the cylinder. The cylinder is oriented to extend along a flow axis of the muffler with respect to the exhaust gasses. In this way the cylinder is configured to deflect sound waves from the internal combustion engine thereby reducing a noise level of the internal combustion engine.

7 Claims, 8 Drawing Sheets

(56) References Cited

U.S. PATENT DOCUMENTS

| | | | | |
|---|---|---|---|---|
| 7,549,512 | B2 * | 6/2009 | Newberry | F01N 1/08 181/281 |
| 8,746,400 | B2 * | 6/2014 | Maejima | F01N 1/089 181/227 |
| 8,869,932 | B2 | 10/2014 | Butler | |
| 11,242,783 | B1 * | 2/2022 | Chen | F01N 1/085 |
| 2011/0005856 | A1 * | 1/2011 | Larson | F01N 1/10 181/252 |
| 2012/0103719 | A1 | 5/2012 | Mead | |

* cited by examiner

CONSTANT VELOCITY MUFFLER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to muffler devices and more particularly pertains to a new muffler device for maximizing the exhaust performance of an internal combustion engine. The device includes a muffler that swells outwardly at a middle of the muffler and a cylinder that is disposed within the muffler. The cylinder is aligned with the swell of the muffler to define an exhaust channel in the muffler that has constant dimensions thereby facilitating exhaust gasses to pass through the muffler at a constant velocity. Furthermore, the cylinder is aligned with a centerline of the muffler thereby deflecting sound waves produced by the internal combustion engine to reduce the noise level of the internal combustion engine.

(2) Description of Related Art Including Information Disclosed Under 37 CFR 1.97 and 1.98

The prior art relates to muffler devices including a muffler which has at least one acoustic chamber and at least one inlet pipe interconnecting the at least one acoustic chambers. The prior art discloses a muffler device that includes two expanding megaphones that are separated by a dual core annular flow silencer. The prior art discloses a muffler device that includes a pair of intersecting flow chambers and a perforated diverter disposed within the muffler. The prior art discloses a muffler device that includes a single inlet which branches into a pair of outlets. The prior art discloses a muffler device that includes a perforated core that is aligned with a flow of the muffler and a plurality of acceleration tubes each disposed between the perforated core and the muffler.

BRIEF SUMMARY OF THE INVENTION

An embodiment of the disclosure meets the needs presented above by generally comprising a muffler that is fluidly coupled to an exhaust pipe of an internal combustion engine to facilitate exhaust gasses to pass through the muffler. A cylinder is disposed within the muffler and the muffler swells outwardly at a middle of the muffler to accommodate the cylinder. The cylinder is oriented to extend along a flow axis of the muffler with respect to the exhaust gasses. In this way the cylinder is configured to deflect sound waves from the internal combustion engine thereby reducing a noise level of the internal combustion engine.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
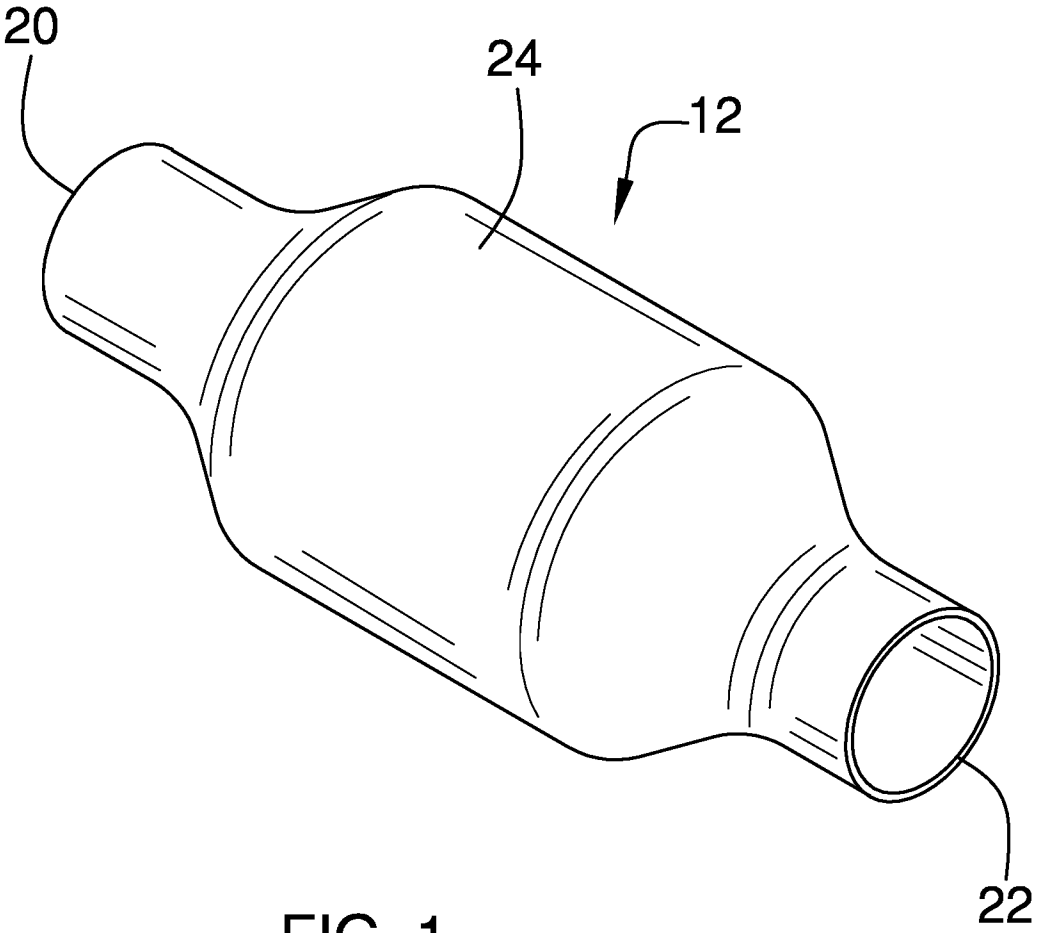
FIG. 1 is a perspective view of a constant velocity muffler assembly according to an embodiment of the disclosure.
Figure 3:
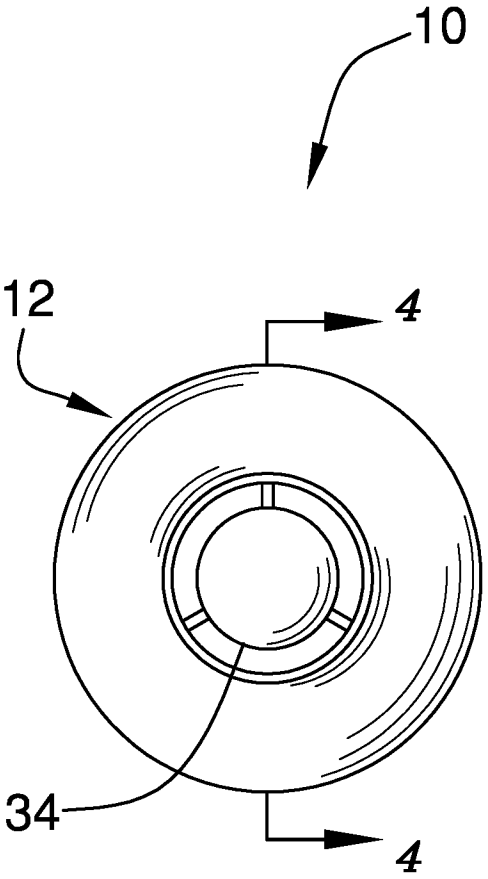
FIG. 3 is a front view of an embodiment of the disclosure.
Figure 2:
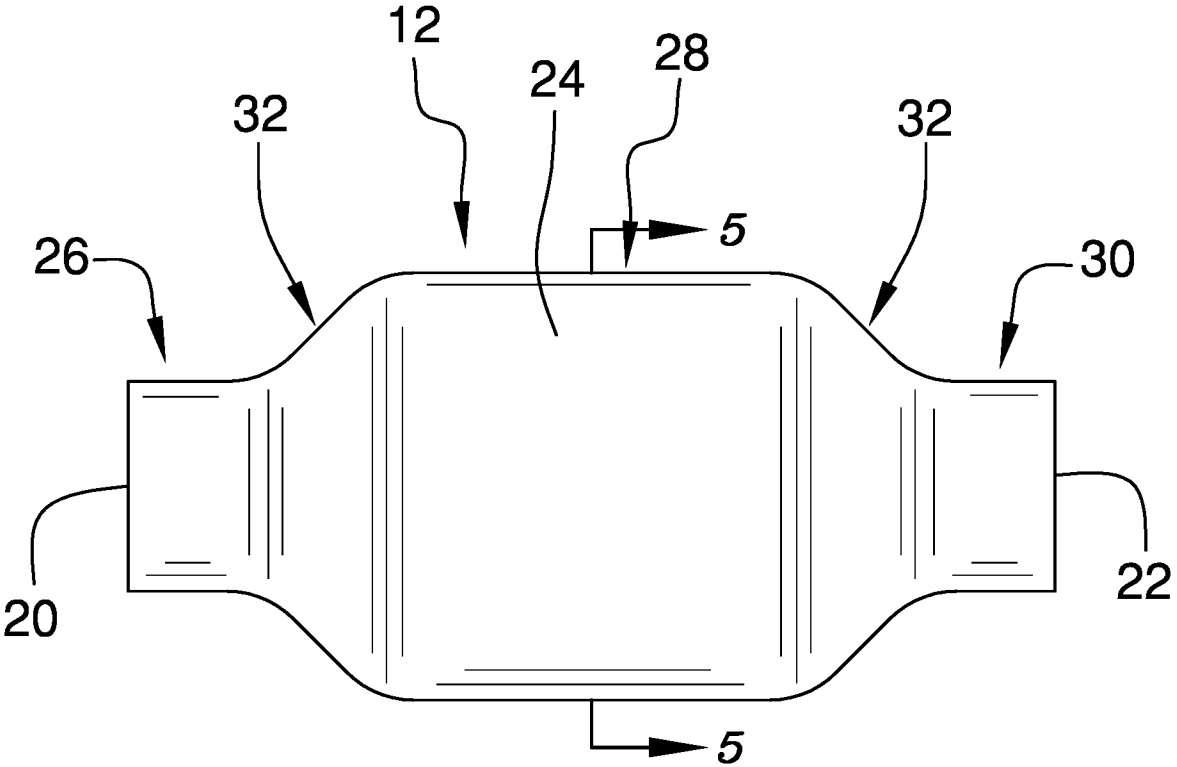
FIG. 2 is a top view of an embodiment of the disclosure.
Figure 5:
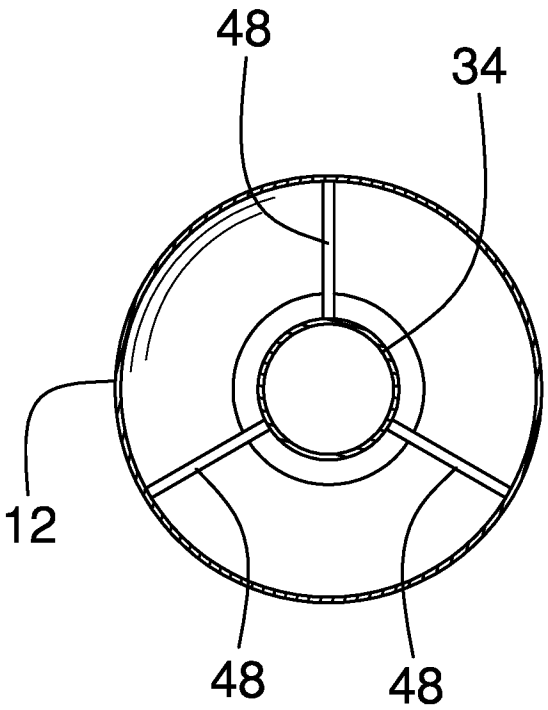
FIG. 5 is a cross sectional view taken along line 5-5 of FIG. 2 of an embodiment of the disclosure.
Figure 4:
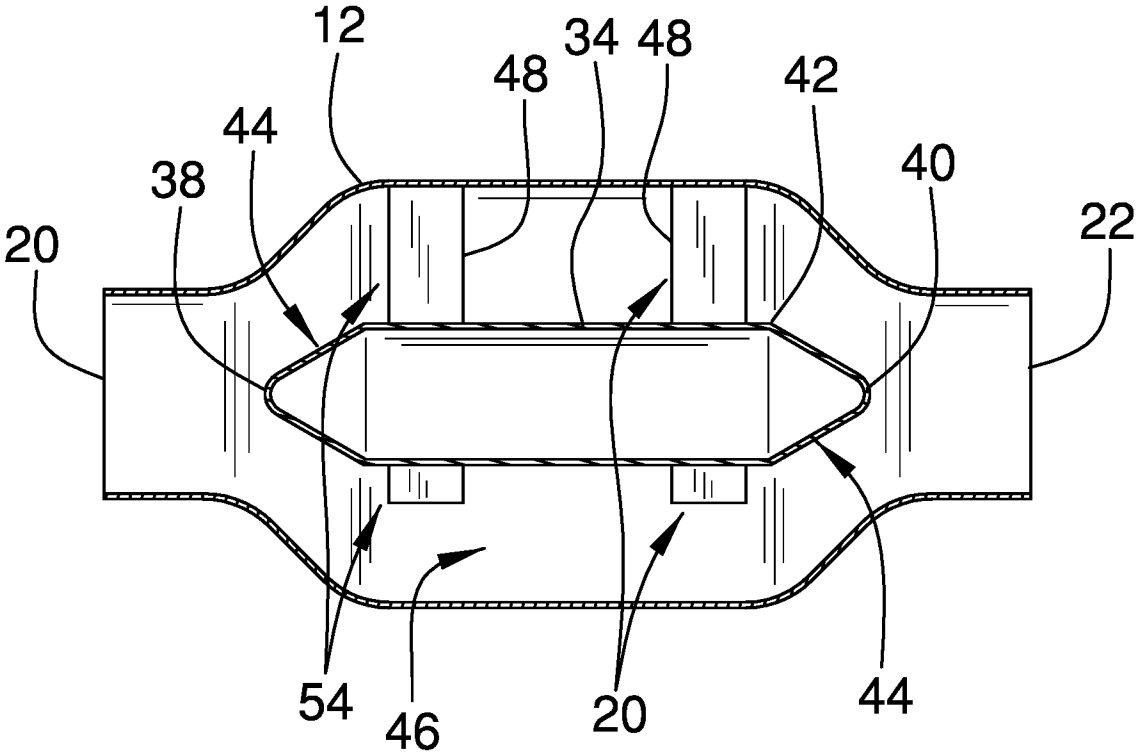
FIG. 4 is a cross sectional view taken along line 4-4 of FIG. 3 of an embodiment of the disclosure.

With reference now to the drawings, and in particular to FIGS. 1 through 11 thereof, a new muffler device embodying the principles and concepts of an embodiment of the disclosure and generally designated by the reference numeral 10 will be described.

As best illustrated in FIGS. 1 through 11, the constant velocity muffler assembly 10 generally comprises a muffler 12 that is fluidly coupled to an exhaust pipe 14 of an internal combustion engine 16 to facilitate exhaust gasses 18 to pass through the muffler 12. The muffler 12 swells outwardly at a middle of the muffler 12. The internal combustion engine 16 may be positioned in a passenger vehicle, a recreational vehicle, a motorcycle or any other type of motorized vehicle that has an internal combustion engine. The muffler 12 has a first end 20 a second end 22 and an outer wall 24 extending between the first end 20 and the second end 22, each of the first end 20 and the second end 22 is open and the muffler 12 is substantially hollow. The outer wall 24 is continuously arcuate about an axis extending through the first end 20 and the second end 22 such that the muffler 12 has a cylindrical shape.

The outer wall 24 has a first portion 26, a second portion 28 and a third portion 30, and the first portion 26 extends from the first end 20 toward the second end 22. Furthermore, the third portion 30 extends from the second end 22 toward the first end 20, and the second portion 28 extends between the first portion 26 and the third portion 30. The outer wall 24 has a pair of shoulders 32 and each of the shoulders 32 is positioned at an intersection between the second portion 28 and a respective one of the first portion 26 and the third portion 30.

A cylinder 34 is disposed within the muffler 12 and the cylinder 34 is oriented to extend along a flow axis of the muffler 12 with respect to the exhaust gasses 18. In this way the cylinder 34 can deflect sound waves 36 from the internal combustion engine 16 thereby reducing a noise level of the internal combustion engine 16. The cylinder 34 has a front end 38, a back end 40 and an exterior wall 42 extending between the front end 38 and the back end 40, and the exterior wall 42 has a pair of sloped portions 44 each tapering to a blunt point at a respective one of the front end 38 and the back end 40. Furthermore, the cylinder 34 is elongated between the front end 38 and the back end 40 such that each of the sloped portions 44 of the exterior wall 42 is aligned with a respective one of the shoulders 32 of the outer wall 24 of the muffler 12. In this way an exhaust passage 46 is defined between the exterior wall 42 of the cylinder 34 and the outer wall 24 of the muffler 12 which has a constant width along an entire length of the muffler 12 to facilitate the exhaust gasses 18 to pass through the muffler 12 at a constant velocity. Thus, the muffler 12 facilitates maximum performance of the internal combustion engine 16 with respect to back pressure and velocity of the exhaust gasses 18.

A plurality of brackets 48 is each coupled between an interior surface 50 of the outer wall 24 of the muffler 12 and an exterior surface 52 of the exterior wall 42 of the cylinder 34 such that the cylinder 34 is centrally positioned in the muffler 12. The plurality of brackets 48 are spaced apart from each other and are distributed around a full circumference of the cylinder 34. The plurality of brackets 48 includes a set of first brackets 54 and a set of second brackets 56. Each of the first brackets 54 is positioned adjacent to the sloped portion 44 of the exterior wall 42 of the cylinder 34 which is associated with the first end 20 of the cylinder 34. Additionally, each of the second brackets 56 is positioned adjacent to the sloped portion 44 of the exterior wall 42 of the cylinder 34 which is associated with the second end 22 of the cylinder 34.

Figure 6:
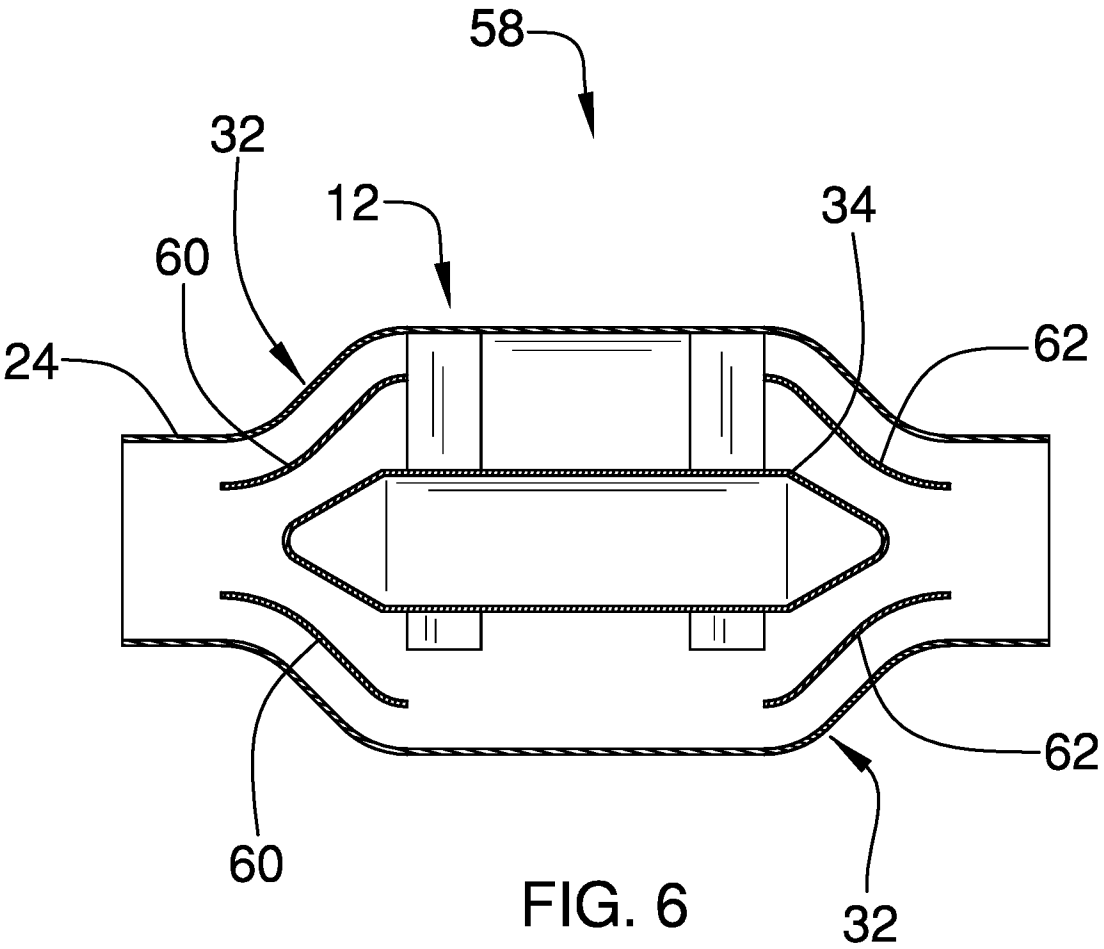
FIG. 6 is a right side cut-away view of an alternative embodiment of the disclosure.

In an alternative embodiment 58 as is most clearly shown in FIG. 6, a set of first baffles 60 is each attached to the interior surface 50 of the outer wall 24 of the muffler 12. The first baffles 60 are aligned with a respective one of the shoulders 32 of the outer wall 24 which extends between the first portion 26 and the second portion 28 of the outer wall 24. Additionally, each of the first baffles 60 is curved to conform to curvature of the respective shoulder 32 to deflect sound waves 36 from the internal combustion engine 16. Continuing in the alternative embodiment 58, a set of second baffles 62 is each attached to the interior surface 50 of the outer wall 24 of the muffler 12. The second baffles 62 are aligned with a respective one of the shoulders 32 of the outer wall 24 which extends between the second portion 28 and the third portion 30 of the outer wall 24. Furthermore, each of the second baffles 62 is curved to conform to curvature of the respective shoulder 32 to deflect sound waves 36 from the internal combustion engine 16.

Figure 7:
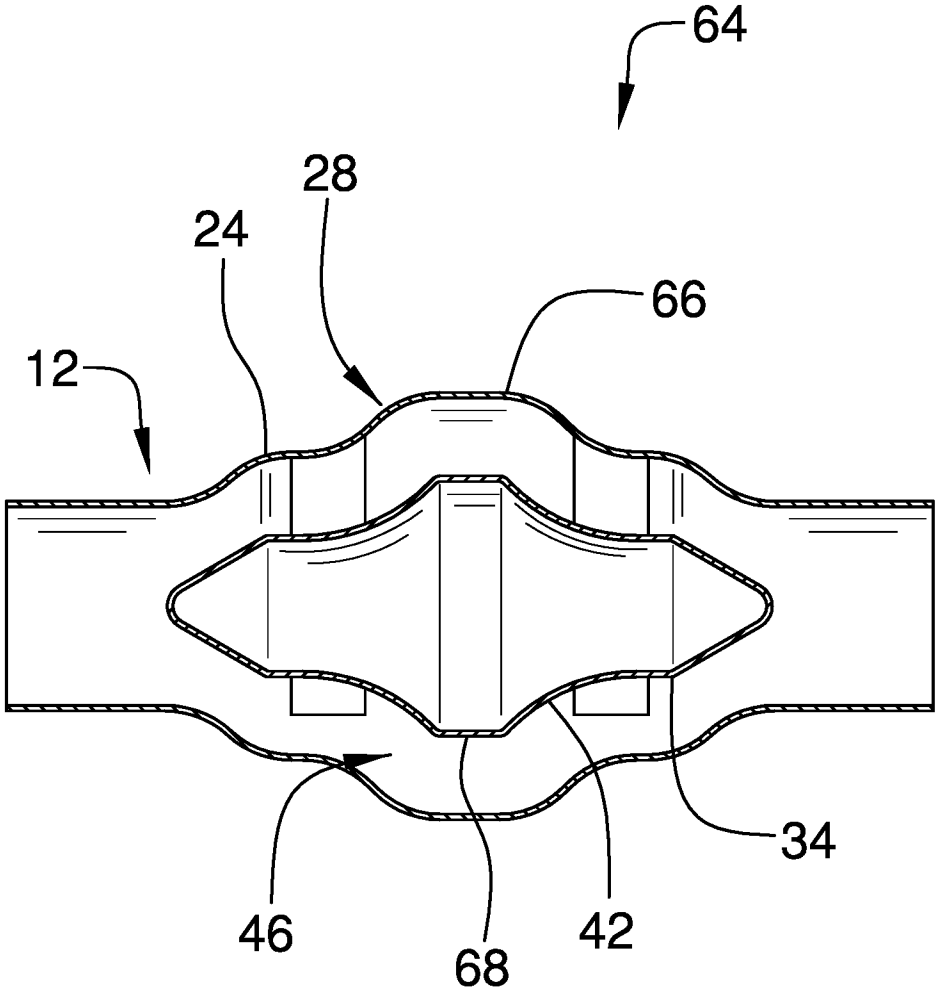
FIG. 7 is a left side cut-away view of an alternative embodiment of the disclosure.
Figure 9:
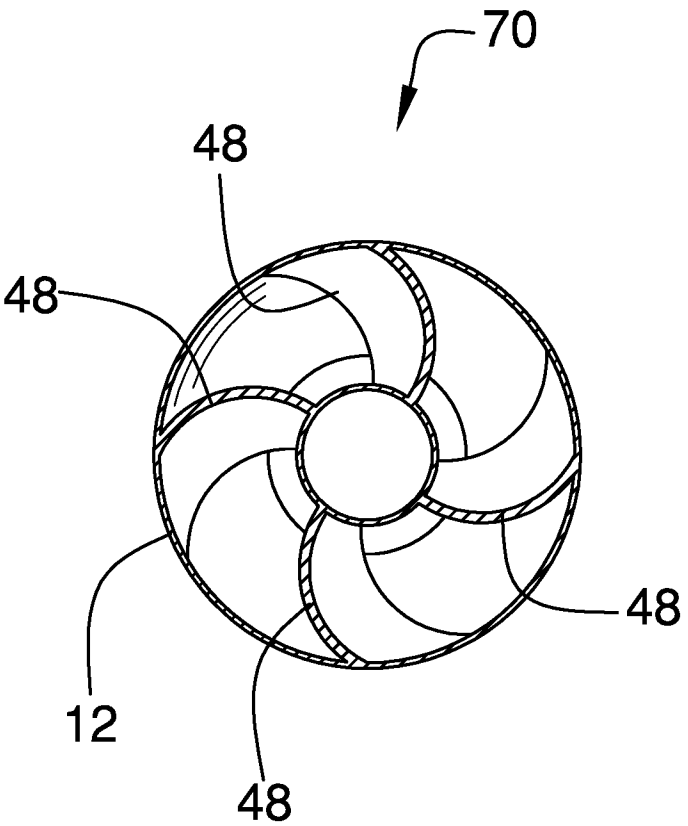
FIG. 9 is a cross sectional view taken along line 9-9 of FIG. 8 of an embodiment of the disclosure.
Figure 8:
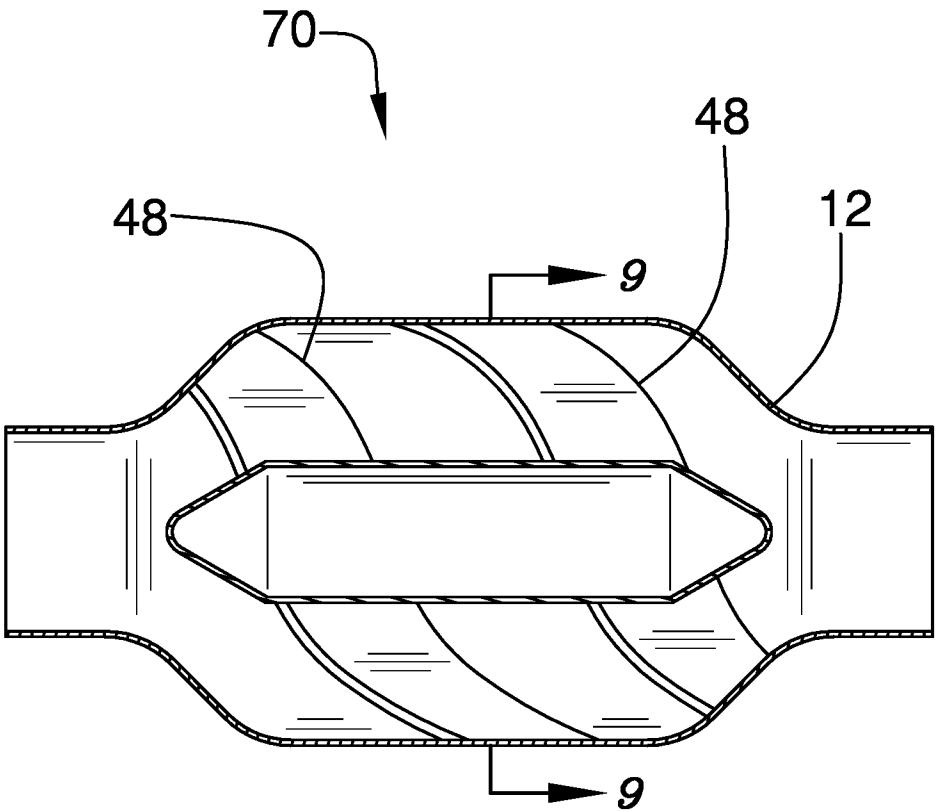
FIG. 8 is a top cut-away view of an alternative embodiment of the disclosure.
Figure 10:
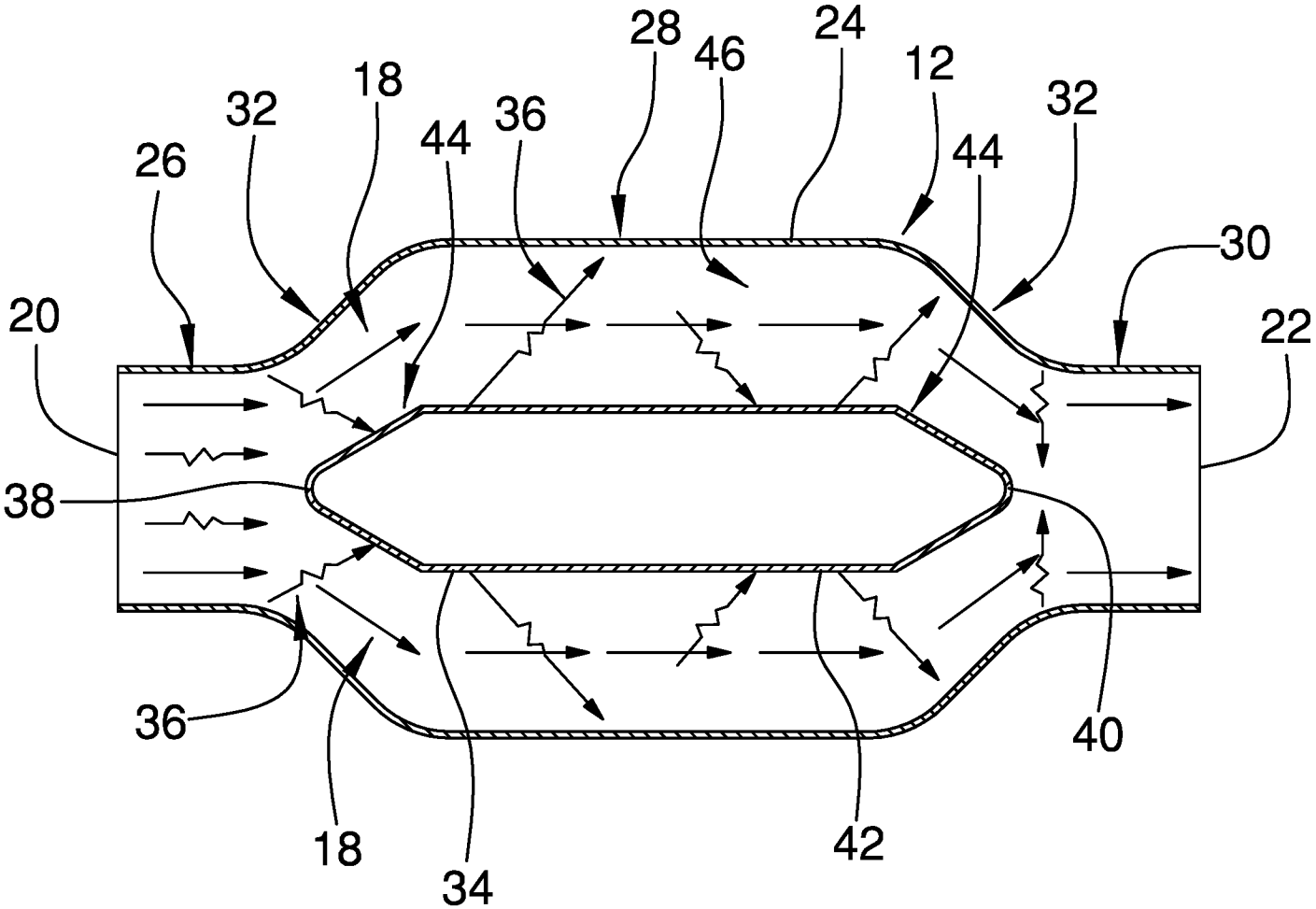
FIG. 10 is a top cut-away view of an embodiment of the disclosure.
Figure 11:
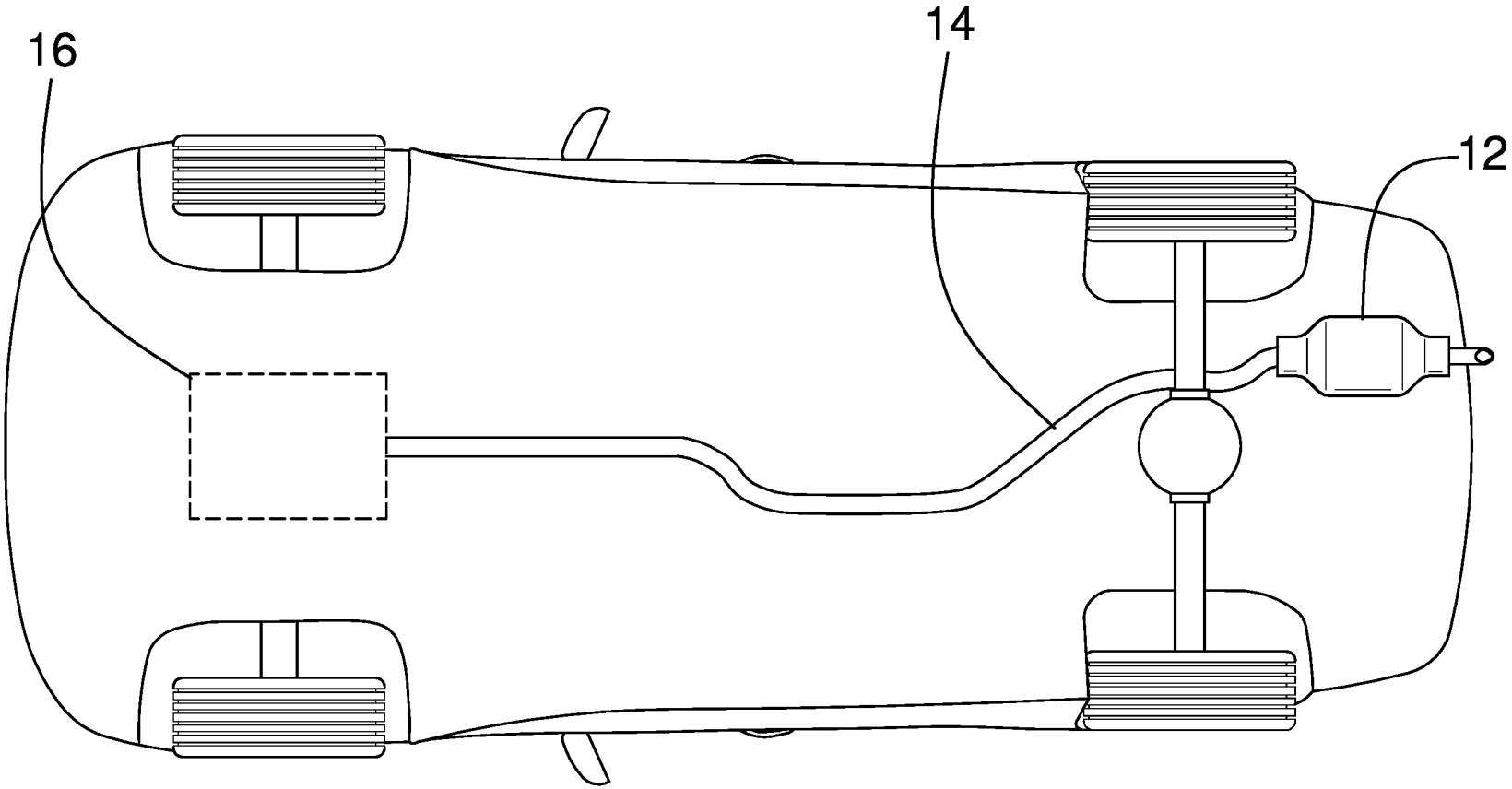
FIG. 11 is a perspective in-use view of an embodiment of the disclosure.

In an alternative embodiment 64 as is most clearly shown in FIG. 7, the outer wall 24 of the muffler 12 corresponding to the second portion 28 of the outer wall 24 has first prominence 66 extending outwardly from the second portion 28. The first prominence 66 is centrally positioned between the pair of shoulders 32 in the outer wall 24 of the muffler 12. Continuing in the alternative embodiment 64 shown in FIG. 7, the exterior wall 42 of the cylinder 34 has a second prominence 68 extending outwardly from the exterior wall 42. The second prominence 68 is aligned with the first prominence 66 such that the exhaust passage 46 defined between the outer wall 24 of the muffler 12 and the exterior wall 42 of the cylinder 34 undulates between the first prominence 66 and the second prominence 68. In an alternative embodiment 70 as is most clearly shown in FIGS. 8 and 9, each of the brackets 48 is twisted along an axis extending between the front end 38 and the back end 40 of the cylinder 34. Thus, each of the brackets 48 defines a spiral such that the spiral defined by each of the brackets 48 directs the exhaust gasses 18 in a spiral when the exhaust gasses 18 pass through the muffler 12.

In use, the first end 20 of the muffler 12 is attached to an exhaust pipe 14 that is fluid communication with the internal combustion engine 16 and the second end 22 of the muffler 12 is attached to a tail pipe 72. In this way the exhaust gasses 18 from the internal combustion engine 16 pass through the muffler 12. Furthermore, the constant dimensions of the exhaust passage 46 defined in the muffler 12 facilitate the exhaust gasses 18 to pass through the muffler 12 at a constant velocity. In this way the performance of the internal combustion engine 16 is maximized with respect to back pressure and flow resistance of the exhaust gasses 18. Furthermore, the cylinder 34 facilitates the sound waves 36 of the internal combustion engine 16 to be deflected as they pass through the muffler 12 to reducing the noise level of the internal combustion engine 16 as much as possible without affecting the performance of the internal combustion engine 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A constant velocity muffler assembly for maintaining a constant velocity of exhaust gasses traveling through a vehicle exhaust pipe, said assembly comprising:

a muffler being fluidly coupled to an exhaust pipe of an internal combustion engine wherein said muffler is configured to facilitate exhaust gasses to pass through said muffler; and a cylinder being disposed within said muffler, said cylinder being oriented to extend along a flow axis of said muffler with respect to the exhaust gasses wherein said cylinder is configured to deflect sound waves from the internal combustion engine thereby reducing a noise level of the internal combustion engine, said muffler swelling outwardly at a middle of said muffler to accommodate said cylinder;

wherein said muffler has a first end, a second end and an outer wall extending between said first end and said second end, each of said first end and said second end being open, said muffler being substantially hollow, said outer wall being continuously arcuate about an axis extending through said first end and said second end such that said muffler has a cylindrical shape;

wherein said outer wall has a first portion, a second portion and a third portion, said first portion extending from said first end toward said second end, said third portion extending from said second end toward said first end, said second portion extending between said first portion and said third portion;

wherein said outer wall has a pair of shoulders, each of said shoulders being positioned at an intersection between said second portion and a respective one of said first portion and said third portion; and wherein said cylinder has a front end, a back end and an exterior wall extending between said front end and said back end, said exterior wall having a pair of sloped portions each tapering to a blunt point at a respective one of said front end and said back end, each blunt point being positioned at a transition from a respective one of said first portion and said third portion and a respective one of said shoulders.

2. The assembly according to claim 1 wherein said cylinder is elongated between said front end and said back end such that each of said sloped portions of said exterior wall is aligned with a respective one of said shoulders of said outer wall of said muffler thereby defining an exhaust passage between said exterior wall of said cylinder and said outer wall of said muffler which has a constant width along an entire length of said muffler wherein said muffler is configured to facilitate the exhaust gasses to pass through said muffler at a constant velocity.

3. The assembly according to claim 1, further comprising a plurality of brackets, each of said brackets being coupled between an interior surface of said outer wall of said muffler and an exterior surface of said exterior wall of said cylinder such that said cylinder is centrally positioned in said muffler, said plurality of brackets being spaced apart from each other and being distributed around a full circumference of said cylinder.

4. The assembly according to claim 3, wherein said plurality of brackets includes a set of first brackets and a set of second brackets, each of said first brackets being positioned adjacent to said sloped portion of said exterior wall of said cylinder which is associated with said front end of said cylinder, each of said second brackets being positioned adjacent to said sloped portion of said exterior wall of said cylinder which is associated with said back end of said cylinder.

5. A constant velocity muffler assembly for maintaining a constant velocity of exhaust gasses traveling through a vehicle exhaust pipe, said assembly comprising:

a muffler being fluidly coupled to an exhaust pipe of an internal combustion engine wherein said muffler is configured to facilitate exhaust gasses to pass through said muffler, said muffler swelling outwardly at a middle of said muffler, said muffler having a first end, a second end and an outer wall extending between said first end and said second end, each of said first end and said second end being open, said muffler being substantially hollow, said outer wall being continuously arcuate about an axis extending through said first end and said second end such that said muffler has a cylindrical shape, said outer wall having a first portion, a second portion and a third portion, said first portion extending from said first end toward said second end, said third portion extending from said second end toward said first end, said second portion extending between said first portion and said third portion, said outer wall having a pair of shoulders, each of said shoulders being positioned at an intersection between said second portion and a respective one of said first portion and said third portion;

a cylinder being disposed within said muffler, said cylinder being oriented to extend along a flow axis of said muffler with respect to the exhaust gasses wherein said cylinder is configured to deflect sound waves from the internal combustion engine thereby reducing a noise level of the internal combustion engine, said cylinder having a front end, a back end and an exterior wall extending between said front end and said back end, said exterior wall having a pair of sloped portions each tapering to a blunt point at a respective one of said front end and said back end, each blunt point being positioned at a transition from a respective one of said first portion and said third portion and a respective one of said shoulders, said cylinder being elongated between said front end and said back end such that each of said sloped portions of said exterior wall is aligned with a respective one of said shoulders of said outer wall of said muffler thereby defining an exhaust passage between said exterior wall of said cylinder and said outer wall of said muffler which has a constant width along an entire length of said muffler wherein said muffler is configured to facilitate the exhaust gasses to pass through said muffler at a constant velocity; and a plurality of brackets, each of said brackets being coupled between an interior surface of said outer wall of said muffler and an exterior surface of said exterior wall of said cylinder such that said cylinder is centrally positioned in said muffler, said plurality of brackets being spaced apart from each other and being distributed around a full circumference of said cylinder, said plurality of brackets including a set of first brackets and a set of second brackets, each of said first brackets being positioned adjacent to said sloped portion of said exterior wall of said cylinder which is associated with said front end of said cylinder, each of said second brackets being positioned adjacent to said sloped portion of said exterior wall of said cylinder which is associated with said back end of said cylinder.

6. The assembly according to claim 5, further comprising a set of first baffles each being attached to said interior surface of said outer wall of said muffler, said first baffles being aligned with a respective one of said shoulders of said outer wall which extends between said first portion and said second portion of said outer wall, each of said first baffles being curved to conform to curvature of said respective shoulder wherein each of said first baffles is configured to deflect sound waves from the internal combustion engine.

7. The assembly according to claim 6, further comprising a set of second baffles each being attached to said interior surface of said outer wall of said muffler, said second baffles being aligned with a respective one of said shoulders of said outer wall which extends between said second portion and said third portion of said outer wall, each of said second baffles being curved to conform to curvature of said respective shoulder wherein each of said second baffles is configured to deflect sound waves from the internal combustion engine.

* * * * *